US009640362B2

(12) United States Patent
Kang et al.

(10) Patent No.: US 9,640,362 B2
(45) Date of Patent: May 2, 2017

(54) PHOTOCATHODE COUPLED X-RAY TUBE

(71) Applicant: Electronics and Telecommunications Research Institute, Daejeon (KR)

(72) Inventors: Jun Tae Kang, Daejeon (KR); Yoon-Ho Song, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 173 days.

(21) Appl. No.: 14/605,830

(22) Filed: Jan. 26, 2015

(65) Prior Publication Data

US 2016/0005565 A1 Jan. 7, 2016

(30) Foreign Application Priority Data

Jul. 2, 2014 (KR) ..... 10-2014-0082554

(51) Int. Cl.
*H01J 35/16* (2006.01)
*H01J 35/06* (2006.01)

(52) U.S. Cl.
CPC ..... *H01J 35/16* (2013.01); *H01J 35/06* (2013.01)

(58) Field of Classification Search
CPC .. H01J 35/00; H01J 35/02; H01J 35/04; H01J 35/06; H01J 35/065; H01J 35/16; G01N 23/04
See application file for complete search history.

(56) References Cited

U.S. PATENT DOCUMENTS 5,768,337 A * 6/1998 Anderson ..... H01J 35/065 378/136
2007/0274453 A1* 11/2007 Dittrich ..... H01J 35/065 378/136
2010/0239071 A1* 9/2010 Takeuchi ..... H01J 35/16 378/121
2010/0290593 A1* 11/2010 Legagneux ..... H01J 35/065 378/122
2012/0148027 A1 6/2012 Jeong et al.
2013/0039474 A1* 2/2013 Turqueti ..... H01J 35/065 378/124
2013/0336459 A1* 12/2013 Choi ..... H01J 35/065 378/122

FOREIGN PATENT DOCUMENTS

KR 10-2002-0096668 A 12/2002

OTHER PUBLICATIONS

Westin, Michael, "Fresnel Reflectance", http://www.graphics.cornell.edu/~westin/misc/fresnel.html, 2011.*

* cited by examiner

*Primary Examiner* — David E Smith

(57) ABSTRACT

Provided is an X-ray tube including an anode, a target on the anode, a cathode disposed separate from the target and the anode and comprising an emitter providing an electron beam to the target, and a side wall disposed between the cathode and the anode, and surrounding the target and the emitter. The side wall reflects a light generated by collision of the electron beam with the target to the cathode, and electrically insulates the cathode from the anode.

20 Claims, 7 Drawing Sheets

PHOTOCATHODE COUPLED X-RAY TUBE

CROSS-REFERENCE TO RELATED APPLICATIONS

This U.S. non-provisional patent application claims priority under 35 U.S.C. §119 of Korean Patent Application No. 10-2014-0082554, filed on Jul. 2, 2014, the entire contents of which are hereby incorporated by reference.

BACKGROUND

The present disclosure herein relates to an X-ray tube, and more particularly, to a photocathode coupled X-ray tube.

Since Roentgen discovered an X-ray, a manufacturing method of an X-ray tube has not been greatly changed. Today, an X-ray tube in a thermal electron emission scheme that heats a filament in a vacuum glass tube is most widely used. Recently, researches are being greatly performed which try to apply a photoelectron emission scheme or an electric field electron emission scheme to an X-ray tube.

Electron emission schemes are largely divided into the thermal electron emission, the field electron emission, and the photoelectron emission.

SUMMARY

The present disclosure provides an X-ray tube capable of maximizing electron emission.

The present disclosure also provides an X-ray tube capable of deriving electron beam emission by a photoelectric effect.

Embodiments of the inventive concept provide X-ray tubes, including: an anode; a target on the anode; a cathode disposed separate from the target and the anode and comprising an emitter providing an electron beam to the target; and a side wall disposed between the cathode and the anode, and surrounding the target and the emitter, wherein the side wall reflects a light generated by collision of the electron beam with the target to the cathode, and electrically insulates the cathode from the anode.

In some embodiments, the side wall may include an oxide. The oxide may include aluminum oxide. The oxide may include silicon oxide.

In other embodiments, the X-ray tube may further include reflection blocks protruding from an inner wall of the side wall and reflecting the light generated at the target to the emitter. The reflection blocks may include first reflection surfaces having slopes increased against the side wall along a direction from the anode to the cathode. The reflection blocks may have a scale shape. The reflection blocks may include a metal oxide or an insulating oxide.

In still other embodiments, the X-ray tube may further include a reflector focusing the light on the emitter from an inner wall of the side wall. The reflector may include a second reflection surface of which a radius is decreased along a direction from the anode to the cathode. The second reflection surface may have a "U", parabola, bell, funnel, or trumpet shape. The reflector may include a metal oxide or an insulating oxide.

In even other embodiments, the X-ray tube may further include a gate disposed between the anode and the cathode and controlling the electron beam between the anode and the cathode. The side wall may include an upper side wall between the anode and the gate, and a lower side wall between the gate and the cathode. The X-ray tube may further include reflection blocks disposed on an inner wall of the upper side wall and reflecting the light generated in the target to the emitter. The reflection blocks may comprise first reflection surfaces having slopes increased against the side wall along a direction from the anode to the cathode. The reflection blocks have a scale shape. The side wall has a cylindrical tube shape, and the reflection blocks have a ring shape formed along an inner wall of the side wall. The X-ray tube may further include a reflector disposed on an inner wall of the upper wall and focusing the light on the emitter. The reflector may have a second reflection surface of which a radius is decreased along a direction from the anode to the cathode. The second reflection surface may have a "U", parabola, bell, funnel, or trumpet shape.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION OF THE EMBODIMENTS

Figure 1:
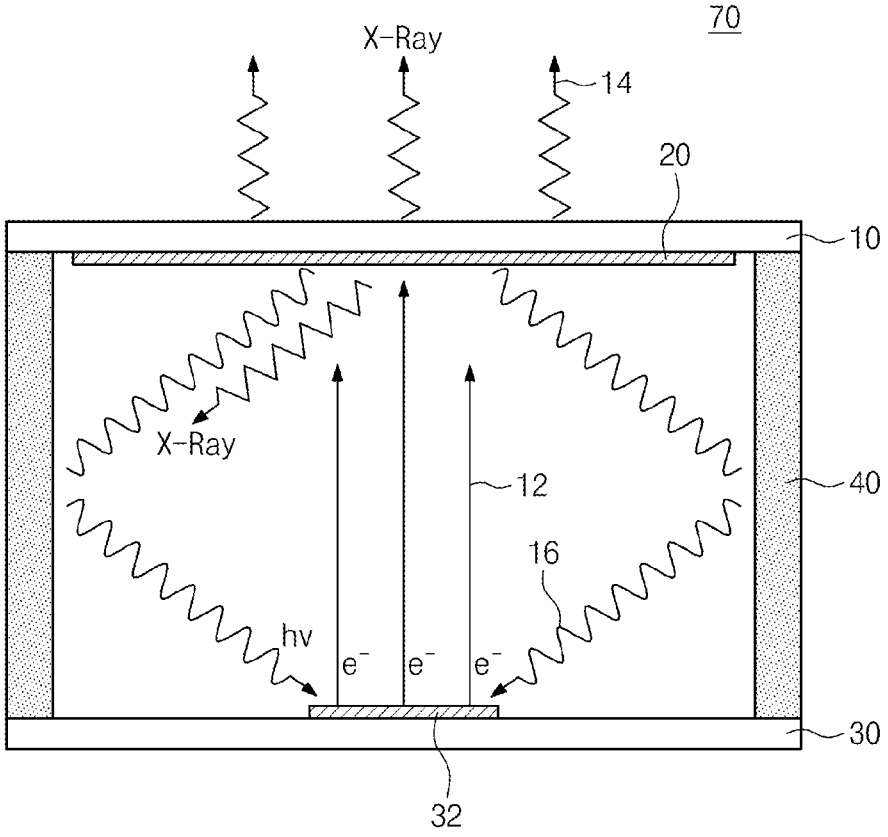
FIG. 1 illustrates an X-ray tube according to a first embodiment of the inventive concept.

Exemplary embodiments of the inventive concept will be described below in more detail with reference to the accompanying drawings. The inventive concept may, however, be embodied in different forms and should not be construed as limited to the embodiments set forth herein. Rather, these embodiments are provided so that this disclosure will be thorough and complete, and will fully convey the scope of the inventive concept to those skilled in the art. The following description with reference to the accompanying drawings is provided to assist in a comprehensive understanding of exemplary embodiments of the invention as defined by the claims and their equivalents. Like reference numerals refer to like elements throughout.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated elements, steps, operations and/or components, but do not preclude the presence or addition of one or more other elements, steps, operations and/or components thereof. In addition, reference numerals shown according to an order of description are not limited to the order.

Hereinafter, exemplary embodiments of the inventive concept will be described in detail with reference to the accompanying drawings.

Figure 2:
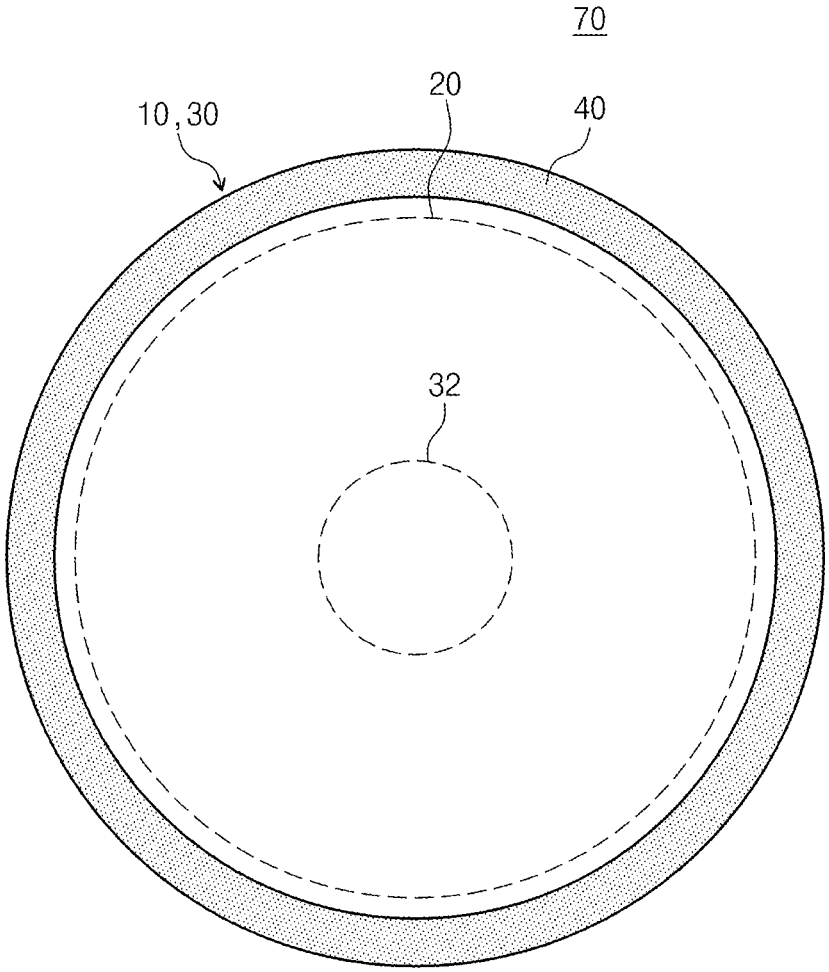
FIG. 2 is a plan view of FIG. 1.

FIG. 1 illustrates an X-ray tube 70 according to a first embodiment of the inventive concept. FIG. 2 is a plan view of FIG. 1.

Referring to FIGS. 1 and 2, the X-ray tube 70 according to the first embodiment of the inventive concept may include an anode 10, a target 20, a cathode 30, and a side wall 40.

The anode 10 may include a metal plate. For example, the anode 10 may include a copper plate. A positive DC voltage may be applied to the anode 10.

The target 20 may be disposed between the anode 10 and the cathode 30. According to an example, the target 20 may be coupled on the anode 10. For example, the target 20 may include a metal such as copper, tungsten, or molybdenum, which is excellent in conductivity.

The cathode 20 may be separated from the anode 10 by a predetermined distance. The cathode 30 may be parallel with the anode 10 and the target 20. The cathode 30 may include an emitter 32. When a DC voltage is applied to the cathode 30, an electron beam 12 may be emitted from the emitter 32. The electron beam 12 may be collided with the target 20. The target 20 may emit an X-ray 14. The X-ray 14 may be transmitted through the anode 10 and the target 20 and proceed towards the same direction as that of the electron beam 12. On the contrary, the target 20 may emit a light 16. The light 16 may have lower energy and a longer wavelength than the X-ray 14. For example, the light 16 may include an ultraviolet ray, a visible light, and an infrared ray. The light 16 may be provided to the emitter 32.

The side wall 40 may be disposed between the anode 10 and the cathode 30. The side wall 40 may fix each edge of the anode 10 and the cathode 30. The side wall 40 may surround the target 20 and the emitter 32. The side wall 40 may prevent electrical short-circuit between the anode 10 and the cathode 30. According to an example, the side wall 40 may include an oxide insulator. The side wall 40 of the oxide insulator may include a metal oxide of ceramic ($Al_2O_3$). The side wall 40 may have a cylindrical tube shape.

The side wall 40 may reflect the light 16 to the emitter 32. The emitter 32 may absorb the light 16. The emitter 32 may emit the electron beam due to the photoelectric effect. The electron beam emission effect may be maximized.

Figure 3:
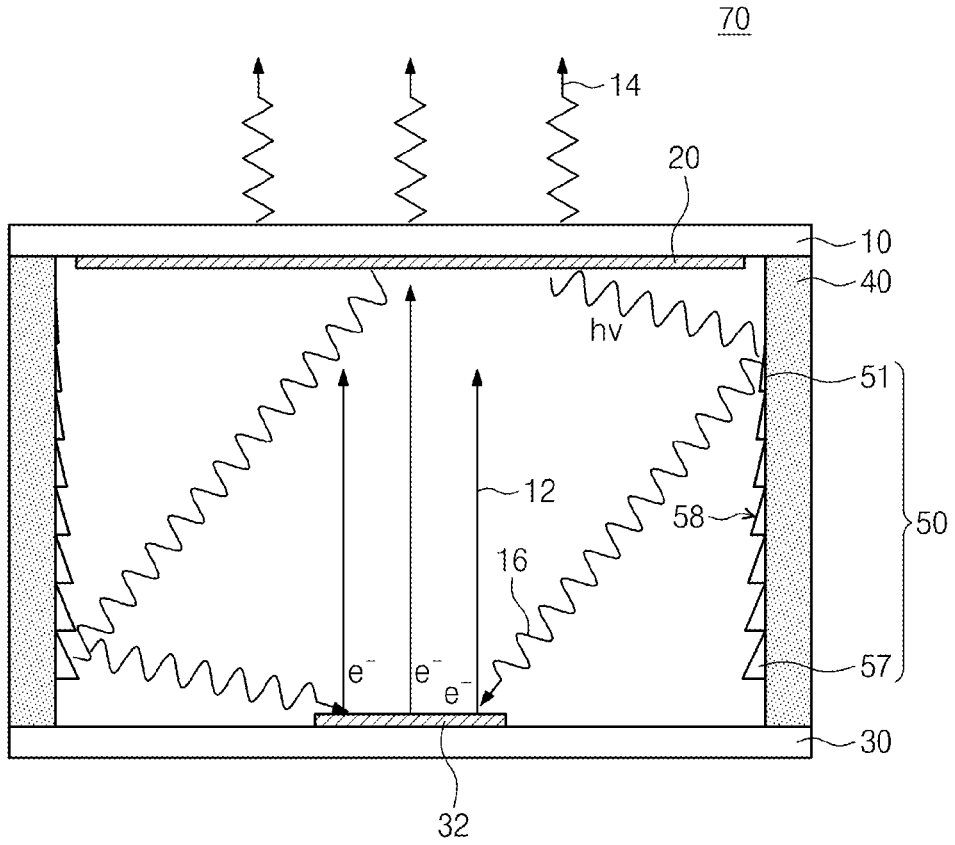
FIG. 3 illustrates a first application example of the X-ray tube in FIG. 1.

FIG. 3 shows a first application example of the X-ray tube in FIG. 1. The X-ray tube may include reflection blocks 50. The reflection blocks 50 may be disposed on the side wall 40 between the anode 10 and the cathode 30. The reflection blocks 50 may protrude internally from the side wall 40. According to an example, the reflection blocks 50 may include an insulating oxide such as a ceramic metal oxide or silicon oxide. The reflection blocks 50 may have a ring shape formed along the inner wall of the side wall 40 of the cylindrical tube shape. The reflection blocks 50 may be inclined against the side wall 40. The light 16 may be reflected by first reflection surfaces 58 of the reflection blocks 50. The reflection blocks 50 may increase reflection efficiency of the light 16 on the side wall 40. According to an embodiment, the reflection blocks 50 may include first to seventh reflection blocks 51 to 57. The first reflection block 51 may disposed adjacent to the anode 10 and the target 20. The seventh block 57 may be disposed adjacent to the cathode 30. A slope of the first reflection surface 58 of the first reflection block 51 may be smaller than that of the first reflection surface 58 of the seventh reflection block 57. The first to seventh reflection blocks 51 to 57 may have a scale shape on the side wall 40. The light 16 may be reflected by the inclined surfaces of the first to seventh reflection blocks 51 to 57 and provided to the emitter 32. An electron beam emission effect of the emitter 32 may be maximized by a photoelectric effect.

Figure 4:
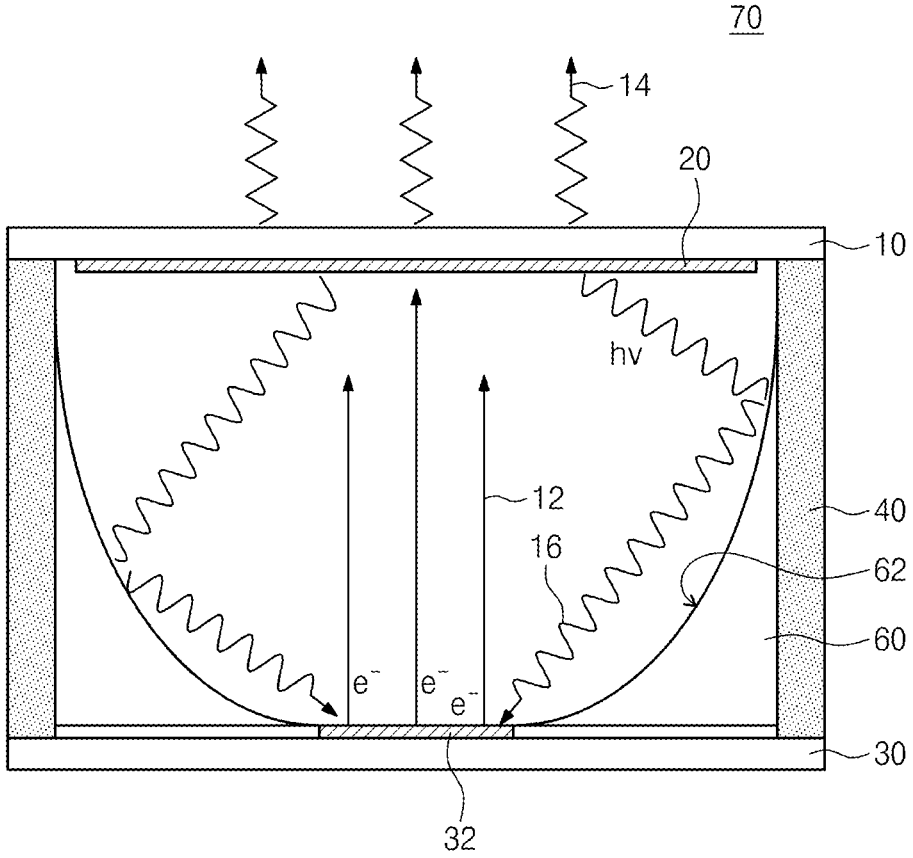
FIG. 4 illustrates a second application example of the X-ray tube in FIG. 2.

FIG. 4 illustrates a second application example of the X-ray tube 70 in FIG. 1. The X-ray tube 70 may include a reflector 60. The reflector 60 may have a second reflection surface 62 reflecting the light 16 to the emitter 32. According to an embodiment, the reflection surface 62 may have a "U", parabola, bell, funnel, or trumpet shape. The emitter 32 may be disposed at the center of the reflector 60. The light 16 may be focused on the emitter 32 at the center of the reflector 60.

Figure 5:
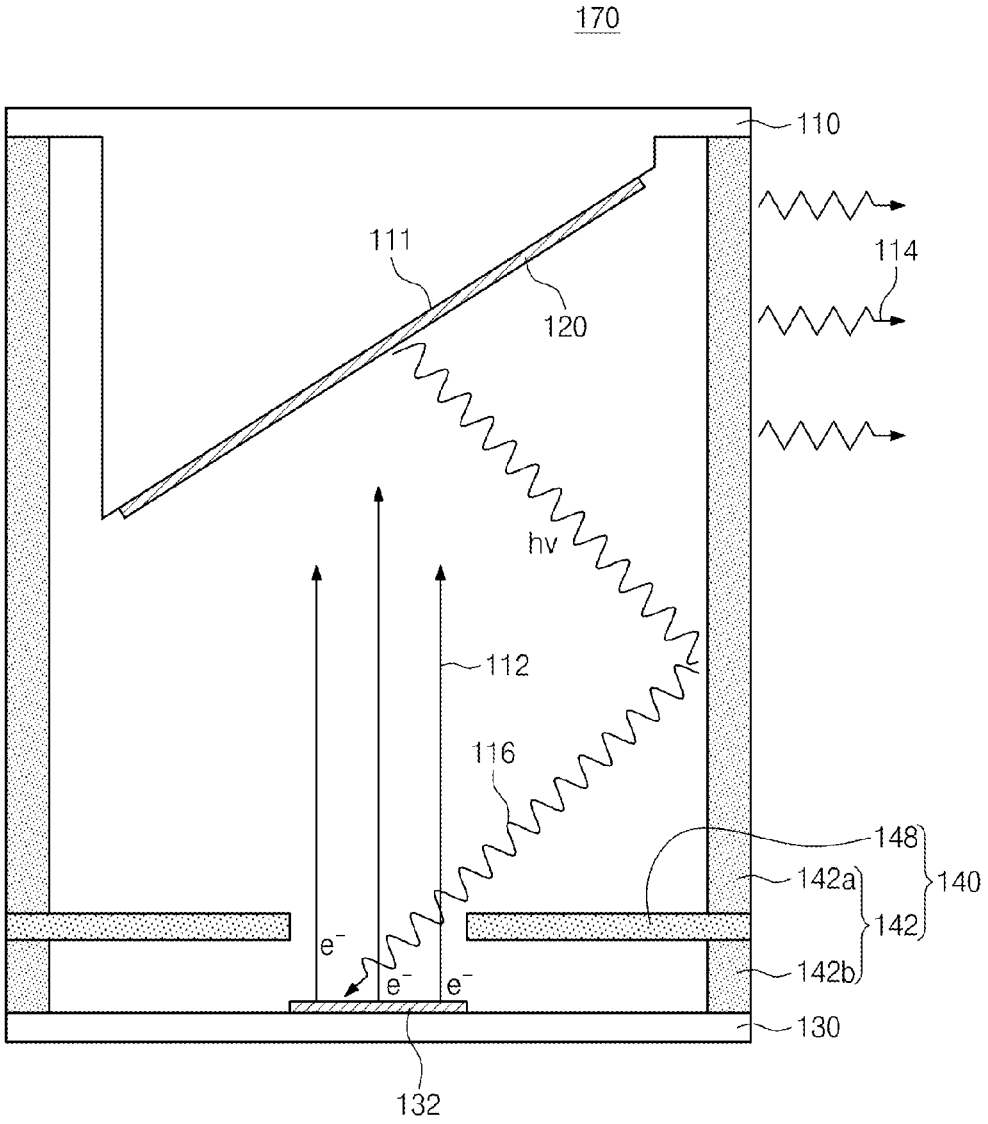
FIG. 5 illustrates an X-ray tube according to a second embodiment of the inventive concept.

FIG. 5 illustrates the X-ray tube 170 according to a second embodiment of the inventive concept. The X-ray tube 170 according to the second embodiment of the inventive concept may include an anode 110, a target 120, a cathode 130, a side wall 140, and a gate 148.

The anode 110 and the cathode 130 may be separated from each other. The side wall 140 may fix the anode 110 and the cathode 130. The anode 10 may fix the target 120 to be inclined against the cathode 130. The target 120 may be disposed on the reflection surface 111 of the anode 110. An emitter 132 of the cathode 130 may provide an electron beam 112 to the target 120. The target 120 may be disposed between the anode 110 and the cathode 130. The electron beam 112 may allow an X-ray 114 and a light 116 to be emitted from the target 120.

The X-ray 114 may proceed towards a different direction from the electron beam 112. The X-ray 114 may be provided to the side wall 140 in the inclined direction of the anode 110. Since the X-ray 114 has higher energy than the light 116, the X-ray 114 may be transmitted through the side wall 140 and emitted externally. On the contrary, the light 116 may be reflected by the side wall 140. The side wall 140 may reflect the light 116 to the emitter 132 of the cathode 130. The emitter 132 may be disposed at the center of the cathode 130.

The gate 148 may be fixed on the side wall 140 between the cathode 130 and the anode 110. The gate 148 and the cathode 130 may be parallel. The gate 148 may receive a DC supply voltage for controlling the electron beam 112.

The side wall 140 may include an insulating oxide such as a metal oxide like ceramic or silicon oxide. The side wall 140 may include a lower side wall 142*b* and an upper side wall 142*a*. The lower side wall 142*b* may be disposed between the gate 148 and the cathode 130. The upper side wall 142*a* may be disposed between the gate 148 and the anode 110.

Figure 6:
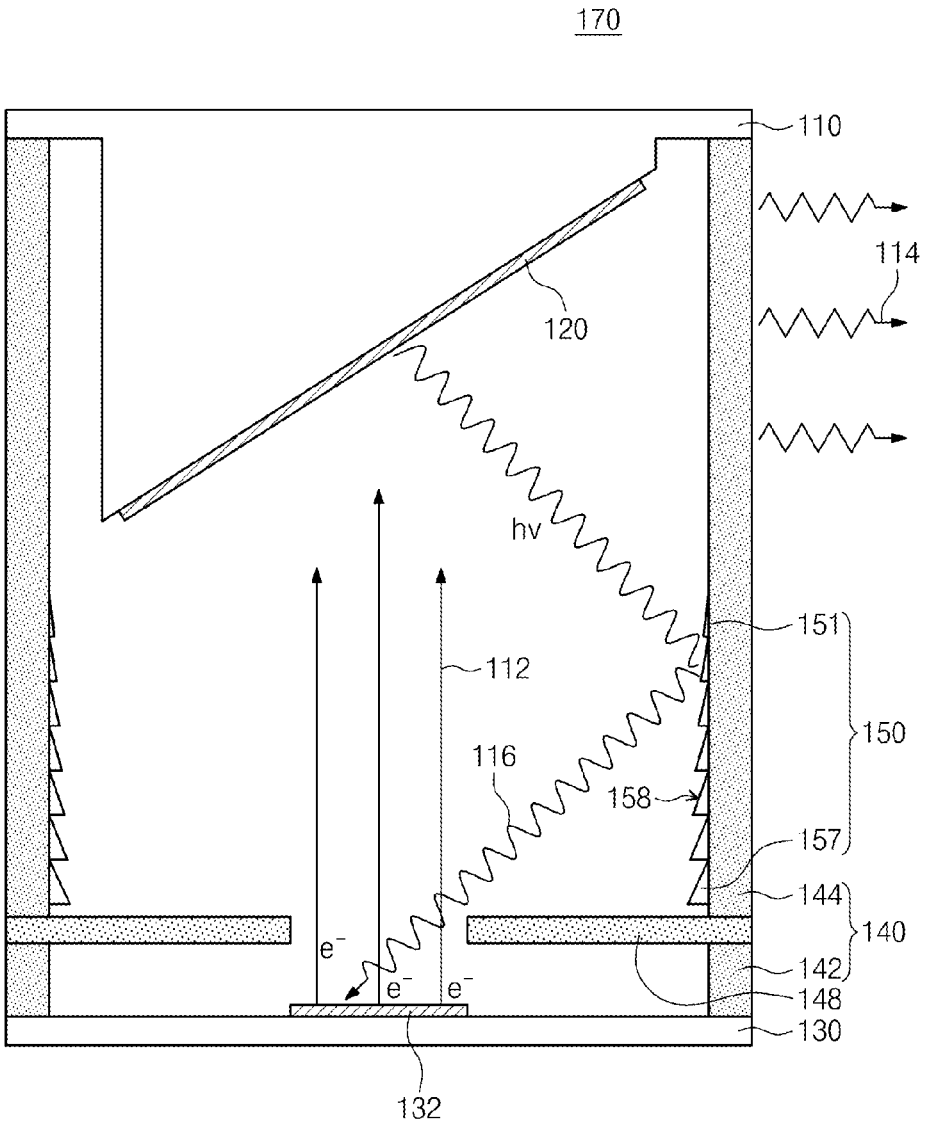
FIG. 6 illustrates a third application example of the X-ray tube in FIG. 5.

FIG. 6 illustrates a third application example of the X-ray tube in FIG. 5. The X-ray tube 170 may include reflection blocks 150. The reflection blocks 150 may be disposed on an upper side wall 144 between the anode 110 and the gate 148. According to an embodiment, the reflection blocks 150 may have first reflection surfaces 158 reflecting the light 116 to the emitter 132. The reflection blocks 150 may include first to seventh reflection blocks 151 to 157. The first reflection block 151 may be disposed adjacent to the anode 110. The seventh reflection block 157 may be adjacent to the gate 148. The first reflection surface 158 of the first reflection block 151 may have a smaller slope than the first reflection surface 158 of the seventh reflection block 157. The first to seventh reflection blocks 151 to 157 may have a scale shape on the upper side wall 144.

Figure 7:
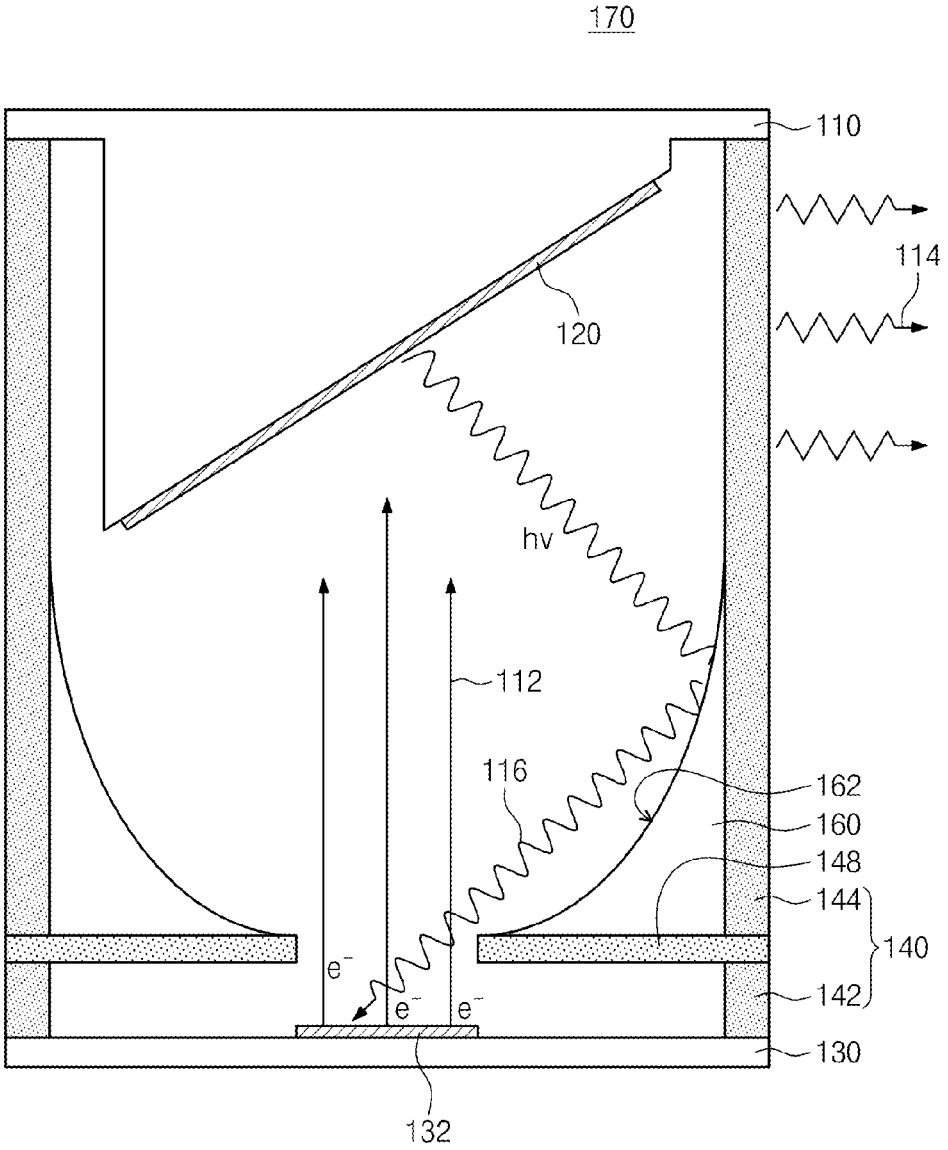
FIG. 7 illustrates a fourth application example of the X-ray tube in FIG. 6.

FIG. 7 illustrates a fourth application example of the X-ray tube in FIG. 6. The X-ray tube 170 may include a reflector 160. The reflector 160 may be disposed on an inner wall of the upper side wall 144. The reflector 160 may have a second reflection surface 162 reflecting the light 116. According to an embodiment, the second reflection surface 162 may have a "U", parabola, bell, funnel, or trumpet shape. The emitter 132 may be disposed at the center of the reflector 160. The light 116 may be focused on the emitter 132.

According to embodiments of the inventive concept, an X-ray tube can include a side wall insulating an anode from a cathode and reflecting a light emitted from a target on the anode to an emitter of the cathode. The emitter can emit electron beams due to a photoelectric effect. The electron beam emission from the emitter can be maximized.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. An X-ray tube comprising:
an anode;
a target disposed on the anode;
a cathode disposed separately from the target and the anode, the cathode comprising an emitter that provides an electron beam to the target; and
a side wall surrounding the target and the emitter and being disposed between the cathode and the anode,
wherein the side wall reflects light to the cathode, the light being generated by collision of the electron beam with the target, the light having a longer wavelength than an X-ray, the side wall electrically insulating the cathode from the anode.

2. The X-ray tube of claim 1, wherein the side wall comprises an oxide.

3. The X-ray tube of claim 2, wherein the oxide comprises aluminum oxide.

4. The X-ray tube of claim 2, wherein the oxide comprises silicon oxide.

5. The X-ray tube of claim 1, further comprising a gate disposed between the anode and the cathode and controlling the electron beam between the anode and the cathode,
wherein the side wall comprises:
an upper side wall disposed between the anode and the gate; and
a lower side wall disposed between the gate and the cathode.

6. An X-ray tube comprising:
an anode;
a target disposed on the anode;
a cathode disposed separately from the target and the anode, the cathode comprising an emitter that provides an electron beam to the target;
a side wall surrounding the target and the emitter and being disposed between the cathode and the anode, the side wall reflecting light to the cathode, the light being generated by a collision of the electron beam with the target, the side wall electrically insulating the cathode from the anode; and
reflection blocks protruding from an inner wall of the side wall and reflecting the light generated at the target to the emitter.

7. The X-ray tube of claim 6, wherein the reflection blocks comprise reflection surfaces having respective slopes, the slopes increasing against the side wall along a direction from the anode to the cathode.

8. The X-ray tube of claim 6, wherein the reflection blocks have a scale shape.

9. The X-ray tube of claim 6, wherein the reflection blocks comprise a metal oxide or an insulating oxide.

10. The X-ray tube of claim 6, further comprising a gate disposed between the anode and the cathode, the gate controlling the electron beam between the anode and the cathode,
wherein the side wall comprises:
an upper side wall disposed between the anode and the gate; and
a lower side wall disposed between the gate and the cathode, and
wherein the reflection blocks are disposed on an inner wall of the upper side wall.

11. The X-ray tube of claim 10, wherein the reflection blocks comprise reflection surfaces having respective slopes, the slopes increasing against the side wall along a direction from the anode to the cathode.

12. The X-ray tube of claim 10, wherein the reflection blocks have a scale shape.

13. The X-ray tube of claim 10, wherein the side wall has a cylindrical tube shape and the reflection blocks have a ring shape formed along an inner wall of the side wall.

14. An X-ray tube comprising:
an anode;
a target disposed on the anode;
a cathode disposed separately from the target and the anode, the cathode comprising an emitter that provides an electron beam to the target;
a side wall surrounding the target and the emitter and being disposed between the cathode and the anode, the side wall reflecting light to the cathode, the light being generated by a collision of the electron beam with the target, the side wall electrically insulating the cathode from the anode; and
a reflector focusing the light on the emitter from an inner wall of the side wall.

15. The X-ray tube of claim 14, wherein the reflector comprises a reflection surface, a radius of the reflection surface decreasing along a direction from the anode to the cathode.

16. The X-ray tube of claim 15, wherein the reflection surface has a "U" shape, a parabola shape, a bell shape, a funnel shape, or a trumpet shape.

17. The X-ray tube of claim 14, wherein the reflector comprises a metal oxide or an insulating oxide.

18. The X-ray tube of claim 14, further comprising a gate disposed between the anode and the cathode, the gate controlling the electron beam between the anode and the cathode,
wherein the side wall comprises:
an upper side wall disposed between the anode and the gate; and
a lower side wall disposed between the gate and the cathode, and
wherein the reflector is disposed on an inner wall of the upper wall.

19. The X-ray tube of claim 18, wherein the reflector has a reflection surface of which a radius decreases along a direction from the anode to the cathode.

20. The X-ray tube of claim 19, wherein the second reflection surface has a "U" shape, a parabola shape, a bell shape, a funnel shape, or a trumpet shape.

* * * * *